US006018913A

United States Patent [19]

Lin

[11] Patent Number: 6,018,913

[45] Date of Patent: Feb. 1, 2000

[54] SLIDING WINDOW WITH IMPROVED CLOSURE

[75] Inventor: Jih-Cheng Lin, Farmington Hills, Mich.

[73] Assignee: Hi-Lex Corporation, Battle Creek, Mich.

[21] Appl. No.: 09/207,008

[22] Filed: Dec. 7, 1998

[51] Int. Cl.[7] ..... E05D 13/00

[52] U.S. Cl. ..... 49/414; 49/360; 49/413

[58] Field of Search ..... 49/120, 121, 360, 49/407, 413, 414, 424, 226, 228, 234, 235, 380; 16/99, 105, 96 R

[56] References Cited

U.S. PATENT DOCUMENTS

| | | | |
|---|---|---|---|
| 2,594,058 | 4/1952 | Myhr | 49/425 |
| 2,627,092 | 2/1953 | Grossman | 49/425 |
| 2,786,240 | 3/1957 | Tobiasz | 49/425 |
| 4,751,766 | 6/1988 | Fahs et al. | 16/332 |
| 4,920,698 | 5/1990 | Friese et al. . | |
| 4,995,195 | 2/1991 | Olberding et al. . | |
| 5,146,712 | 9/1992 | Hlavaty . | |
| 5,531,046 | 7/1996 | Kollar et al. . | |
| 5,613,323 | 3/1997 | Buening . | |
| 5,724,769 | 3/1998 | Cripe et al. . | |
| 5,822,922 | 10/1998 | Grumm et al. | 49/380 |
| 5,906,026 | 5/1999 | Junttila | 49/407 |

*Primary Examiner*—Daniel P. Stodola
*Assistant Examiner*—Curtis A. Cohen
*Attorney, Agent, or Firm*—Young & Basile, P.C.

[57] ABSTRACT

A sliding window assembly having a guide track and sliding pane geometry which ensures that the sliding pane maintains a vertical, untilted orientation when it is slid along the guide track to a closed position. The sliding pane is retained along its lower edge in the guide track for sliding horizontal sliding movement between open and closed positions. The pane has a projection extending downwardly from its lower edge adjacent its trailing edge when the pane is sliding toward the closed position, and the upper surface of the guide track along which the pane slides is generally horizontal except for an inclined section which slopes upwardly toward the closed position of the pane. The inclined section is located along the length of guide track so that it is immediately beneath the projection of the pane when it is in the closed position. The projection slides upwardly onto the inclined section as the pane reaches the closed position, thereby urging the trailing edge of the pane upwardly to counteract the tendency of the pane to tilt outwardly at its upper ends as it is driven to the closed position. A window assembly having two opposingly slidable panes is also provided, each of the panes having a downwardly extending projection formed adjacent its inboard edge and the lower guide track having an inclined sections to contact each of the panes.

19 Claims, 3 Drawing Sheets

SLIDING WINDOW WITH IMPROVED CLOSURE

FIELD OF THE INVENTION

The present invention relates to horizontally sliding window assemblies such as those used on motor vehicles, and more specifically to a sliding window assembly having means for ensuring the complete and proper closing of the sliding pane or panes.

BACKGROUND OF THE INVENTION

It is known to fit the rear window opening of a truck cab with a sliding window assembly consisting of a pair of stationary window panes mounted upward in the window opening to define a gap therebetween, and one or two window panes retained along their upper and lower edges in guide tracks for horizontal sliding movement. In a window assembly having a single sliding pane, the pane is movable between a closed position wherein it completely closes the gap between the fixed panes and an open position wherein it is slid toward one side or the other to overlap one of the fixed panes and thereby leave the gap unobstructed. In a window assembly having two sliding panes, the panes are slidable between a closed position wherein the panes meet in the middle of the gap and an open position wherein they are slid in opposite directions away from one another, each overlapping one of the stationary panes.

The sliding panes may be moved between the open and closed positions by hand or by a power actuated window regulator. Various designs for such powered regulators have been proposed, most of them employing a reversible electric motor to drive a cable, slotted tape, or a rack-and-pinion mechanism to move the slidable pane or panes along the guide tracks between the open and closed position. These prior art regulators typically extend along the lower edge of the window opening adjacent to or below the lower guide track so that the regulator is relatively unobtrusive and blocks a minimum amount of the window opening. In such a case, the drive member of the regulator is attached to the window pane immediately adjacent its lower edge, either within or just above the lower guide track. This configuration results in the motive force supplied by the regulator being applied to the sliding pane adjacent its lower edge, well below the center of mass of the pane.

To ensure that the pane may slide freely and does not bind within the guide tracks, there must be some amount of vertical clearance between the upper edge of the sliding pane and the upper guide track when the lower edge of the window is resting upon the lower guide track. This clearance allows the sliding pane to tilt slightly within the guide tracks as the motive force urges the pane along its path of travel. The top edge of the pane tilts in the direction opposite the direction in which the force is applied.

If the sliding pane tilts only a small amount there is little adverse effect on operation of the window assembly except when the pane reaches the fully closed position. Since the pane tilts such that the upper edge of the pane lags the lower edge, a gap is created between the upper edge of the pane and the edge or grommet with which it seals. This gap is particularly pronounced in the case of a window assembly with two sliding panes, since both of the panes will tilt outwardly from one another adjacent their upper ends, thus creating a V-shaped gap between the panes.

SUMMARY OF THE INVENTION

It is an objective of this invention to provide a sliding window assembly wherein the tendency of the sliding pane or panes to tilt within the guide tracks when driven to a closed position is minimized.

It is a further objective of this invention to provide a guide track and sliding pane geometry which ensures that the sliding pane maintains a vertical, untilted orientation when it is slid along the guide track to a closed position.

In general, these objectives are achieved by a sliding window assembly comprising at least one sliding pane and having means for urging upwardly on the pane adjacent a trailing lateral edge thereof when it is in the closed position, thereby counteracting the tendency of the top edge of the pane to tilt away from the closed position. In a window assembly having two opposingly slidable panes, it is preferable that means be provided to urge upwardly on the trailing or outboard edges of both of the panes.

In a preferred embodiment of the invention disclosed herein, a dual sliding window assembly has two sliding panes are retained along their lower edges in a guide track and each pane has a projection extending downwardly from its lower edge adjacent the outboard lateral edge, that is, the trailing edge when the pane is sliding toward the closed position. The upper surface of the guide track along which the panes slide is generally horizontal except for two inclined sections, one for each sliding pane, which slope upwardly toward the center of the window assembly. The inclined sections are located along the length of guide track so that each one is immediately beneath the projection of one of the panes when they are in the closed position, adjacent one another. The projections thus slide upwardly onto their respective inclined sections of the guide track as the panes reach the closed position, thereby urging the trailing edges of the panes upwardly to counteract the tendency of the pane to tilt outwardly from one another at their upper ends.

In a first embodiment of the invention, each sliding pane has a second downwardly extending projection formed adjacent its inboard edge, the leading edge when the pane is sliding to the closed position. The portion of the guide track located at the center of the window assembly, between the inclined sections, is substantially horizontal and is lower than the highest points of the inclined sections. The sliding panes make contact with the slide surface of the guide only at the outboard and inboard edges of the panes, the projections at the inboard edges of the windows sliding on this horizontal section between the inclined section while the outboard projections slide on the respective horizontal sections outboard of the inclined sections.

In a second embodiment of the invention, the surface of the guide track at the center of the window assembly, between the two inclined sections, is substantially level with the highest points of the inclined sections, and the lower edges of the panes are substantially flat inboard of their respective projections. The flat lower edges of the panes thus slide along the center section of the guide rail while the outboard projections slide along their respective outboard horizontal sections.

Although both of these embodiments depict the window assembly as having dual sliding panes, the invention may also be practiced with a single sliding pane.

DETAILED DESCRIPTION OF THE PREFERRED EMBODIMENT

Figures 1, 8:
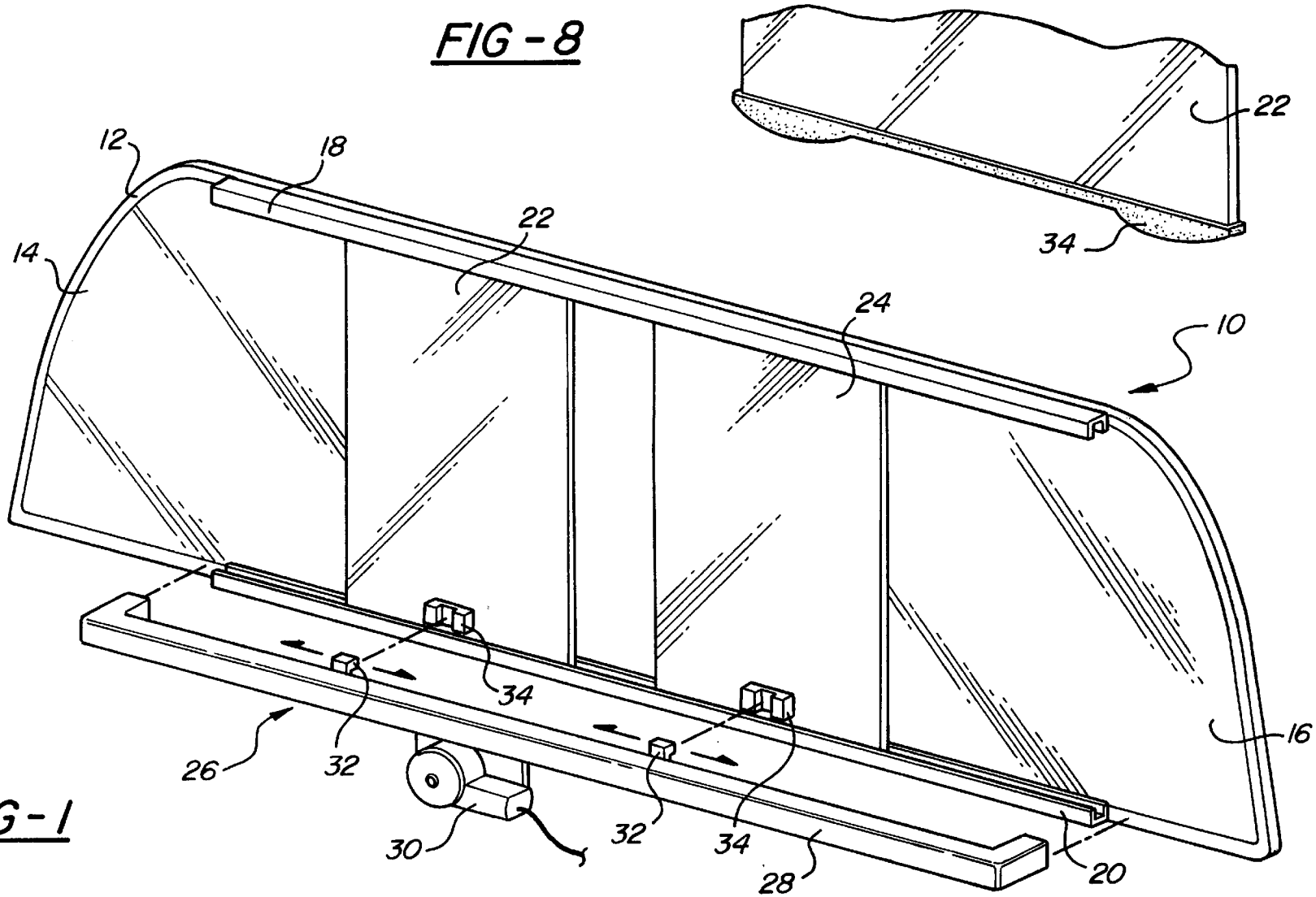
FIG. 1 is a perspective view of a dual sliding window assembly according to the invention.
FIG. 8 is a fragmentary view of a sliding pane having projections formed separately from the pane and affixed thereto.

Referring to FIG. 1, a sliding window assembly 10 comprises a window frame 12, first and second fixed panes 14,16 located at opposite ends of the frame, upper and lower guide tracks 18,20 extending across the top and bottom of the frame 12 respectively, and first and second sliding panes 22,24 mounted in the guide tracks for movement toward one another to a closed position and away from one another to an open position. One or both of the sliding panes 22,24 may have flexible seal strips affixed along their inboard edges to ensure a water-tight seal when in the closed position, but such seals are not shown.

A power actuated window regulator 26 is secured to the bottom edge of the frame 12, to the surfaces of the fixed panes 22,24, or to any fixed structure below or outboard of the frame. As is well known in the art, the regulator 26 comprises a housing 28 containing linear actuation means such as one or more cables (not shown) and guide means such as pulleys (not shown). The linear actuation means is driven by a reversible electric motor 30 mounted to the housing 28 and are attached to first and second actuator arms 32 which engage attachment blocks 34 fixed to the sliding panes 22,24 adjacent their lower edges. Rotation of the electric motor 30 in a first direction causes the linear actuation means to move the actuator arms 32 in opposing directions toward one another to slide the sliding panes 22,24 to their inboard, closed positions. Rotation of the electric motor 30 in the opposite direction causes the linear actuation means to move the actuator arms 32 in opposing directions away from one another to slide the sliding panes 22,24 to their outboard, open positions. An example of a window regulator usable with the present invention is disclosed in U.S. patent application Ser. No. 09/122,605, assigned to the Assignee of the present Application.

Figure 2:
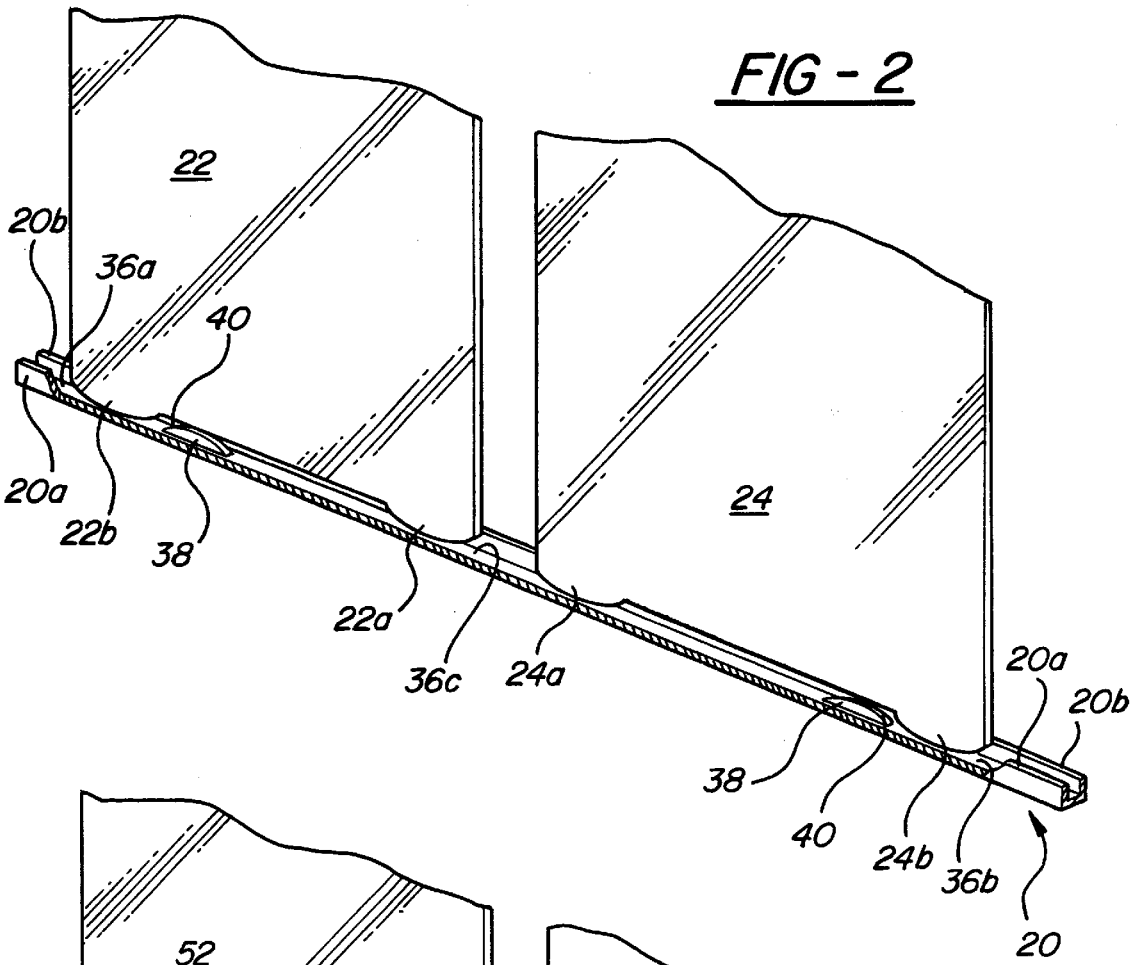
FIG. 2 is a partial view of a first embodiment of the invention window assembly with the regulator removed and the front of the lower guide track cut away.

As best seen in FIG. 2, the lower edges of the sliding panes 22,24 have respective first projection 22*a*,24*a* extending downwardly adjacent their inboard edges and a second projections 22*b*,24*b* extending downwardly adjacent their outboard edges. The projections 22*a*,22*b*,24*a*,24*b* may be formed integrally with the glass making up the panes 22,24, as shown in FIG. 2. Alternatively, the projections, along with some or all of the lower edge of the pane, may be formed as a separate component 34 from plastic or the like, and attached to the pane by adhesive or some other means as shown in FIG. 8.

The lower guide track 20 is generally U-shaped in cross section and has front and rear walls 20*a,b* spaced by a distance sufficient to receive therebetween the sliding panes 22,24. The projections 22*a*,22*b*,24*a*,24*b* rest on and slide along an upper slide surface 36 forming the bottom of the U. The slide surface 36 is generally flat and level along the length of the guide track 20 except for first and second bumps 38 which divide the slide surface into outboard horizontal sections 36*a,b* and a center horizontal section 36*c*. The bumps 38 are located so as to be just inboard of the outboard projections 22*b*,24*b* of the respective sliding panes 22,24 when the panes are in the fully closed position. The difference in height between the bumps 38 and the horizontal sections 36*a,b,c* is less than the distance which the projections 22*a*,22*b*,24*a*,24*b* extend below the lower edges of the panes 22,24. The outboard-facing sides of the bumps 38 constitute inclined sections 40 which slope upward from the outboard horizontal sections 36*a,b*.

Figure 4:
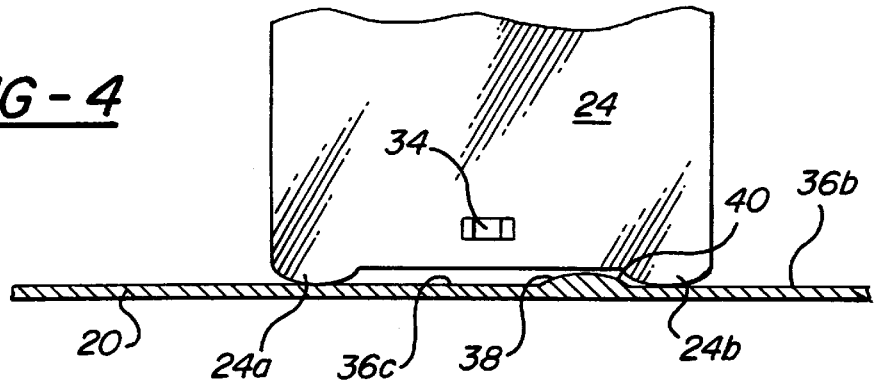
FIG. 4 is a schematic view of the first embodiment of the invention with a single sliding pane in a partially open position.
Figure 5:
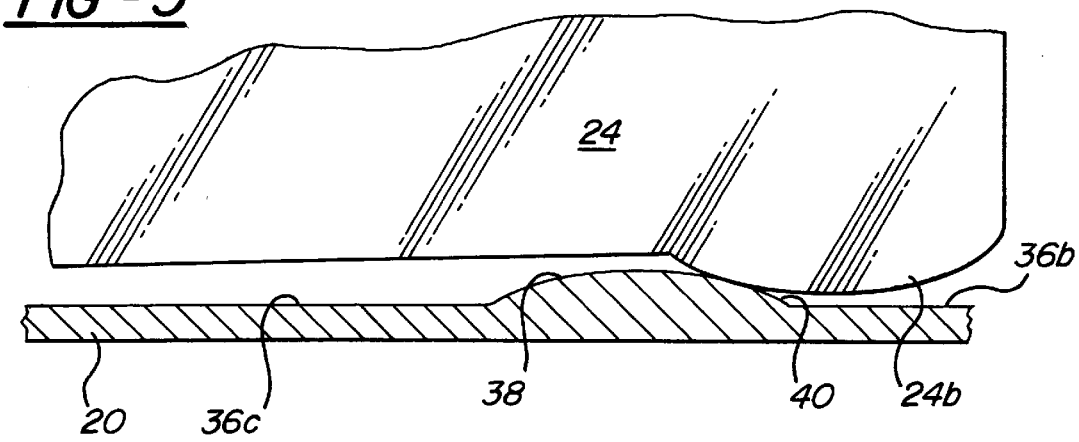
FIG. 5 is a schematic view of the window of FIG. 4 in a fully closed position.

As the panes 22,24 slide between the closed and open positions, the bumps 38 remain between the inboard and outboard projections 22*a*,22*b*,24*a*,24*b* of the respective panes. Until the sliding panes 22,24 near their fully closed position, the panes slide along the guide tracks 18,20 no differently than prior art sliding windows. As seen in FIGS. 4 and 5, however, during the last bit of sliding travel of each pane to its closed position, the outboard projection 22*b*,24*b* rides up onto the inclined section 40 of the respective bump 38. This urges the outboard edge of the pane upward slightly and so causes the sliding pane to tilt slightly in the counterclockwise direction (as viewed in FIGS. 4 and 5), thus counteracting any tendency of the sliding pane to tilt in the clockwise direction due to the application of the sliding force to the lower edge of the pane.

Figure 3:
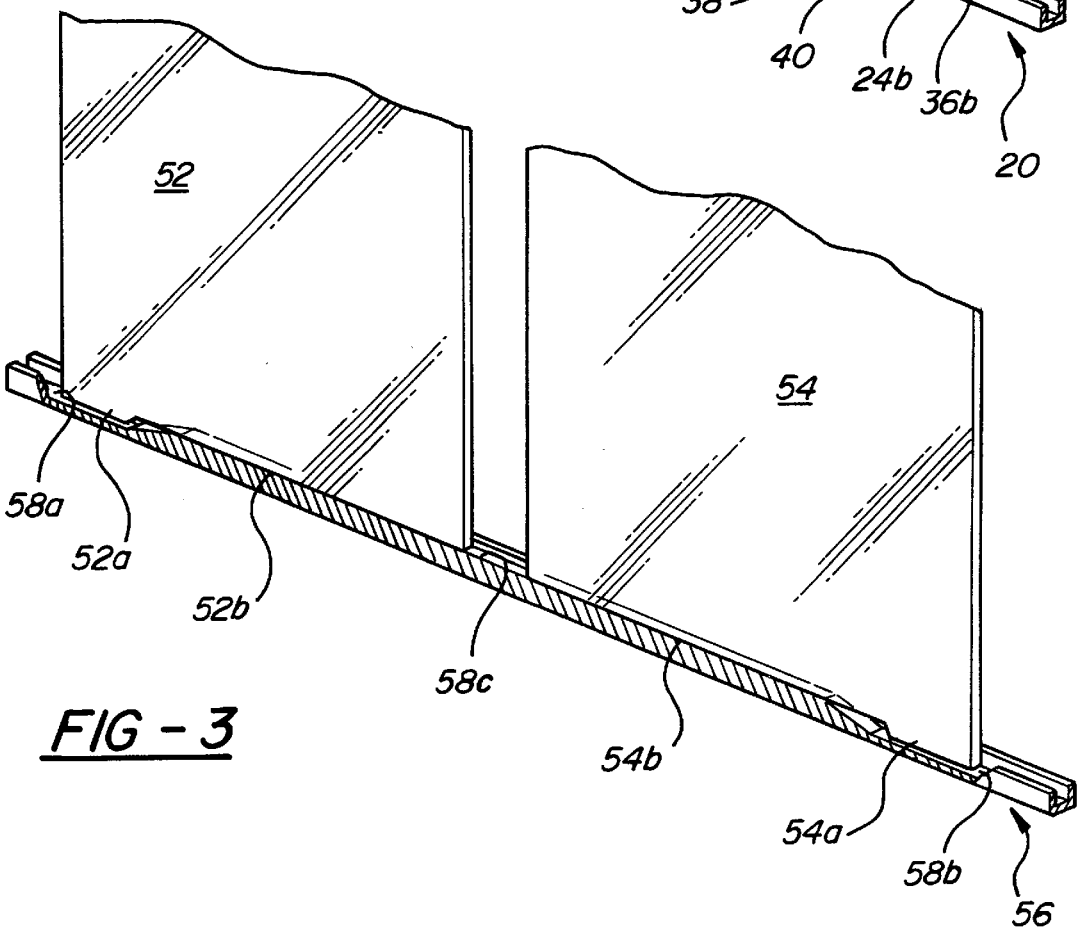
FIG. 3 is a partial view of a second embodiment of the invention window assembly with the regulator removed and the front of the lower guide track cut away.
Figure 6:
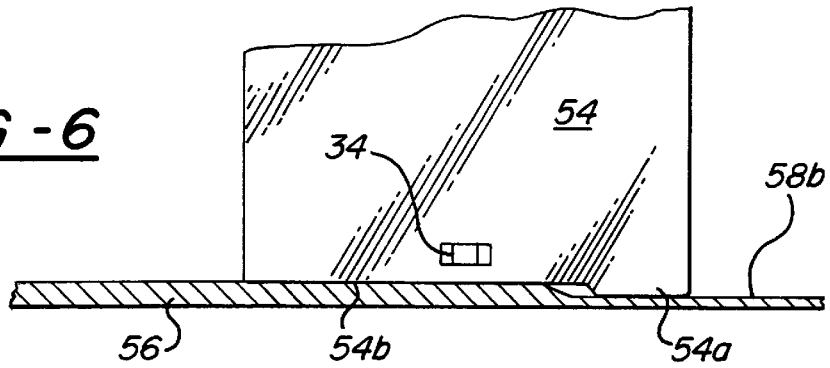
FIG. 6 is a schematic view of the second embodiment of the invention with a single sliding pane in a partially open position.
Figure 7:
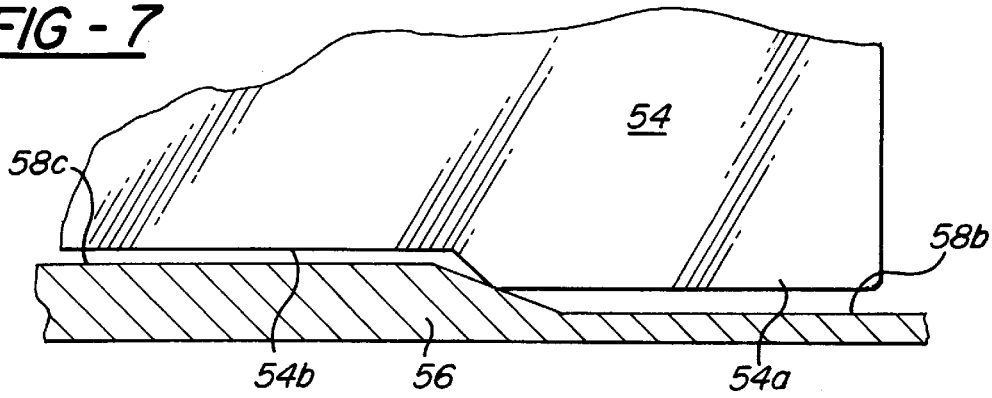
FIG. 7 is a schematic view of the window of FIG. 6 in a fully closed position.

FIGS. 3, 6 and 7 depict a sliding window assembly 50 according to a second embodiment of the invention wherein the lower edge of the sliding panes 52,54 have only one projection 52*a*,54*a* formed at the outboard edge thereof. The remainder of the lower edge of each pane is substantially flat, as indicated at 52*b*,54*b*. The lower guide track 56 has a slide surface comprising an outboard horizontal sections 58*a,b* at either, a center horizontal section 58*c* which is slightly higher than the outboard horizontal sections, and first and second inclined sections 60*a,b* connecting the outboard and center horizontal sections.

The difference in elevation between the outboard horizontal sections 58*a,b* and the center horizontal section 58*c* of the guide surface is approximately equal to the height difference between the flat portion 52*b*,54*b* of the bottom edges of the sliding panes and the lowest point of the projections 52*a*,54*a*. Accordingly, the sliding panes 52,54 are level when they are seated on the guide surface 58, with the bottom of the projections 52*a*,54*a* contacting the respective outboard horizontal sections 58*a,b* and the flat lower edges 52*b*,54*b* of the panes contacting the center inboard section 58*c* of the slide surface.

The inclined sections 60*a,b* are positioned just inboard of the positions of the projections 52*a*,54*a* when the panes are in the fully closed position. Consequently, as the sliding panes 52,54 reach the fully closed position the projections 52*a*,54*a* begins to ride up the respective inclined sections 60*a,b* and the panes are thereby urged upwardly adjacent their outboard edges.

As is apparent from the foregoing description, the invention sliding window assembly counteracts tilting of the sliding pane or panes within the guide tracks that may tend to occur when they are driven to the closed position, thereby ensuring that a proper seal is achieved.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A sliding window assembly comprising:

a substantially horizontal lower guide track having first and second ends and an upwardly oriented slide surface;

at least one pane having first and second lateral edges and a lower edge, the lower edge of the pane resting upon the slide surface with the first edge oriented toward the first end of the track and the second edge oriented toward the second end of the track, the pane slidable along the track toward the first end of the track to a closed position and toward the second end of the track to an open position;

a projection extending downwardly from the lower edge of the pane adjacent the second edge thereof; and an inclined section of the slide surface sloping upward from a horizontal section of the slide surface disposed toward the second end of the guide track, the inclined section located so as to be in contact with the projection when the pane is in the closed position, whereby sliding the pane to the closed position causes the projection to slide from the horizontal section upwardly onto the inclined section and the second edge of the pane is thereby urged upwardly.

2. A sliding window assembly according to claim 1 having two panes slidable toward each other to the closed position and away from each other to the open position.

3. A sliding window assembly according to claim 1 wherein the slide surface has a second horizontal section relatively lower than a highest point of the inclined section and extending from the inclined section toward the first end of the guide track, and a second projection extends downwardly from the lower edge of the pane adjacent the first edge thereof to slidingly contact the second horizontal section.

4. A sliding window assembly according to claim 1 wherein the slide surface has a second horizontal section substantially level with a highest point of the inclined section and extending from the inclined section to the first end of the guide track.

5. A sliding window assembly according to claim 1 wherein the projection is formed integrally with the pane.

6. A sliding window assembly according to claim 1 wherein the projection is formed separately from the pane and affixed thereto.

7. A power actuated sliding window assembly comprising a substantially horizontal lower guide track having an upwardly oriented slide surface, and at least one pane having first and second lateral edges and a lower edge resting upon the slide surface such that the first edge is oriented toward the first end of the track and the second edge is oriented toward the second edge of the track, the pane slidable along the guide track toward the first end of the track to a closed position and toward the second end of the track to an open position, the window assembly characterized in that:

a projection extends downwardly from the lower edge of the pane adjacent the second edge thereof, and the slide surface of the guide track has a horizontal section and an inclined section sloping upwardly from the horizontal section and located adjacent the horizontal section toward the first edge of the pane, the inclined section further located so as to be in contact with the projection when the pane is in the closed position, whereby sliding the pane to the closed position causes the projection to slide from the horizontal section upwardly onto the inclined section and the second edge of the pane is thereby urged upwardly.

8. A sliding window assembly according to claim 7 wherein the slide surface has a second horizontal section relatively lower than a highest point of the inclined section and extending from the inclined section toward the first edge of the pane, and a second projection extends downwardly from the lower edge of the pane adjacent the first edge thereof to slidingly contact the second horizontal section.

9. A sliding window assembly according to claim 7 wherein the slide surface has a second horizontal section substantially level with a highest point of the inclined section and extending from the inclined section toward the first edge of the pane.

10. A sliding window assembly according to claim 7 having two panes slidable toward each other to the closed position and away from each other to the open position, the slide surface having inclined sections adjacent the second edges of each of the panes.

11. A sliding window assembly according to claim 7 wherein the projection is formed integrally with the pane.

12. A sliding window assembly according to claim 7 wherein the projection is formed separately from the pane and affixed thereto.

13. A power actuated sliding window assembly comprising a lower guide track having opposite first and second outer ends and an upwardly oriented slide surface, and first and second panes each having an outer edge disposed toward the respective outer end of the guide track, an inner edge disposed toward a center point of the guide track, and a lower edge retained by the lower guide track for horizontal sliding movement along the slide surface, the panes slidable toward one another to a closed position and away from one another to an open position, the window assembly characterized in that:

at least one of the panes has a projection extending downwardly from the lower edge thereof adjacent the outer edge of the at least one pane, and the slide surface of the guide track has an inclined section and a horizontal section lower than a highest point of the inclined section and extending from the inclined section outwardly from the center of the guide track, the inclined section being located so as to be in contact with the projection when the at least one pane is in the closed position, whereby sliding the at least one pane to the closed position causes the projection to slide from the horizontal section to the inclined section and the outer edge of the at least one pane is thereby urged upwardly.

14. A sliding window assembly according to claim 13 wherein the slide surface has a second horizontal section relatively lower than a highest point of the inclined section and extending from the inclined section toward the center of the guide track, and a second projection extends downwardly from the lower edge of the at least one pane adjacent the first edge thereof to slidingly contact the second horizontal section.

15. A sliding window assembly according to claim 13 wherein the slide surface has a second horizontal section substantially level with a highest point of the inclined section and extending from the inclined section toward the center of the guide track.

16. A power actuated sliding window assembly comprising a substantially horizontal lower guide track having first and second ends and an upwardly oriented slide surface, and at least one pane having first and second lateral edges disposed toward the first and second ends of the guide track respectively and a lower edge resting upon the slide surface, the pane slidable along the guide track toward the first end of the track to a closed position and toward the second end of the track to an open position, the window assembly characterized in that:

a projection extends downwardly from the lower edge of the pane adjacent the second edge thereof, and the slide surface of the guide track has a horizontal section adjacent the second end of the guide track and an inclined section sloping upwardly from the horizontal section toward the first end of the guide track, the inclined section being located so as to be in contact with the projection when the pane is in the closed position, whereby sliding the pane to the closed position causes the projection to slide from the horizontal section upward onto the inclined section so that the second edge of the pane is urged upwardly.

17. A sliding window assembly according to claim 16 wherein the slide surface has a second horizontal section lower than a highest point of the inclined section and extending from the inclined section toward the first end of the guide track, and a second projection extends downwardly from the lower edge of the pane adjacent the first edge thereof to slidingly contact the second horizontal section.

18. A sliding window assembly according to claim 16 wherein the slide surface has a second horizontal section substantially level with a highest point of the inclined section and extending from the inclined section toward the first end of the guide track.

19. A sliding window assembly according to claim 16 further comprising a second pane having first and second lateral edges disposed toward the second and first ends of the guide track respectively, the second pane slidable along the guide track toward the second end thereof to a closed position wherein the first edges of the panes are adjacent one another and toward the first end thereof to an open position wherein the panes are spaced from one another, the second pane having a projection extending downwardly from the lower edge of the pane adjacent the second edge thereof, and the slide surface having a second horizontal section adjacent the first end of the guide track and a second inclined section sloping upwardly from the second horizontal section toward the second end of the guide track, the second inclined section being located so as to be in contact with the projection of the second pane when the second pane is in the closed position, whereby sliding the second pane to the closed position causes the projection to slide from the second horizontal section upward onto the second inclined section so that the second edge of the second pane is urged upwardly.

* * * * *